US007067084B1

(12) United States Patent
Leroy et al.

(10) Patent No.: US 7,067,084 B1
(45) Date of Patent: Jun. 27, 2006

(54) PACKAGE FOR A PHARMACEUTICAL PRODUCT AND METHOD OF MANUFACTURING AND STERILIZING THE PACKAGE

(75) Inventors: Bernard Leroy, Quintenas (FR); Christèle Gatel, Annonay (FR); Jean Christophe Hermange, Annonay (FR)

(73) Assignee: Novartis AG, Basel (CH)

( * ) Notice: Subject to any disclaimer, the term of this patent is extended or adjusted under 35 U.S.C. 154(b) by 624 days.

(21) Appl. No.: 10/110,916

(22) PCT Filed: Oct. 16, 2000

(86) PCT No.: PCT/EP00/10159

§ 371 (c)(1),
(2), (4) Date: Nov. 20, 2002

(87) PCT Pub. No.: WO01/28885

PCT Pub. Date: Apr. 26, 2001

(30) Foreign Application Priority Data

Oct. 18, 1999 (EP) ..... 99120609

(51) Int. Cl.
*B29C 43/22* (2006.01)
*B65D 83/04* (2006.01)
*C12M 1/24* (2006.01)

(52) U.S. Cl. ..... 264/503; 206/528; 435/243; 435/289.1

(58) Field of Classification Search ..... 264/503; 206/528; 435/243, 289.1
See application file for complete search history.

(56) References Cited

U.S. PATENT DOCUMENTS 4,364,220 A 12/1982 Rausing ..... 53/411
5,246,106 A 9/1993 Johnson ..... 206/217
5,439,643 A * 8/1995 Liebert ..... 422/25
6,248,986 B1 * 6/2001 Tran et al. ..... 219/679
6,290,801 B1 * 9/2001 Krampe et al. ..... 156/289
6,303,363 B1 * 10/2001 Ward ..... 435/243
6,379,949 B1 * 4/2002 Ward ..... 435/304.1
6,436,499 B1 * 8/2002 Krampe et al. ..... 428/40.1

FOREIGN PATENT DOCUMENTS

| | | |
|---|---|---|
| EP | 25 621 | 9/1980 |
| FR | 1.338.948 | 8/1963 |
| FR | 2 698608 | 3/2003 |
| WO | WO98/57523 | * 12/1998 |
| WO | WO2000/26338 | * 5/2000 |
| WO | WO2001/28885 | * 4/2001 |

* cited by examiner

*Primary Examiner*—Vickie Kim
(74) *Attorney, Agent, or Firm*—Thomas R. Savitsky; Robert J. Gorman, Jr.

(57) ABSTRACT

The invention relates to a plastic package for a pharmaceutical product, particularly a blister package to dispense liquids or strings, and a method of manufacturing and sterilizing said package. The blister package (1) consists of a lower base portion (2) and a cover member (3). The lower portion includes a cavity indicated generally as (4) which is advantageously formed by inclined sidewalls (5) and upstanding side walls (6) and a bottom (7) which has a circular, flat and smooth surface. The cavity (4) is surrounded by outward extending flange (8). Cover member (3) is welded completely to flange (8) around the opening of cavity (4). Cavity (4) is sized to receive a pharmaceutical product, preferably an ophthalmologic product. The inclined side walls (5) preferably have a rounded geometry to avoid sharp edges for safety reasons. The upstanding side walls (6) have preferably no rounded portions in order to stabilize the cavity (4) as in the contact area of the side walls (5, 6) and the cavity (4) is quite rigid.

15 Claims, 6 Drawing Sheets

Figure 1:
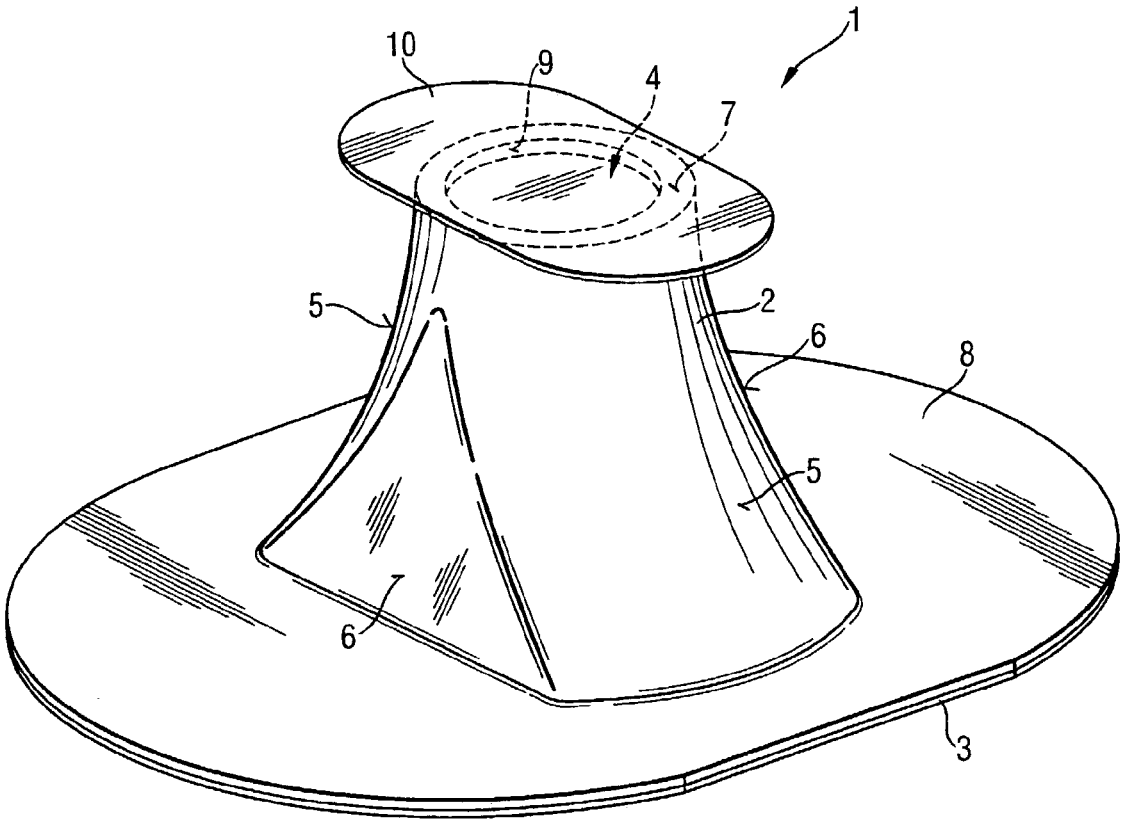

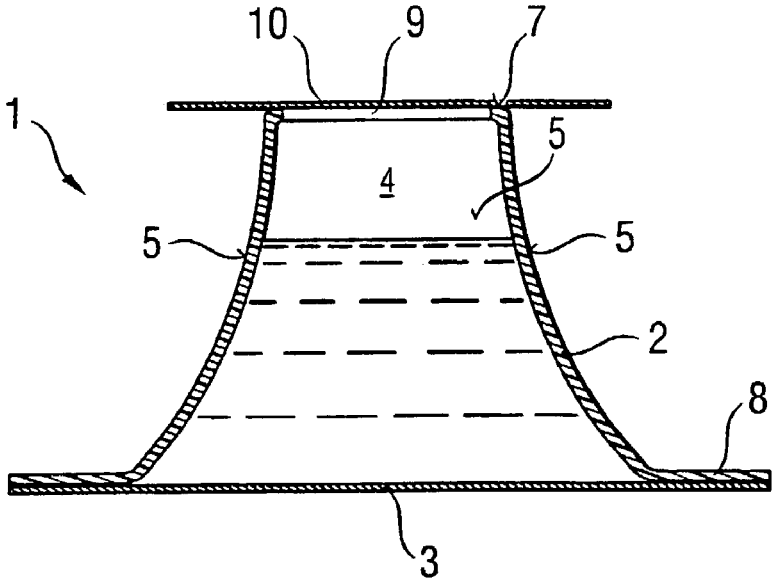
Fig. 4
Fig. 5
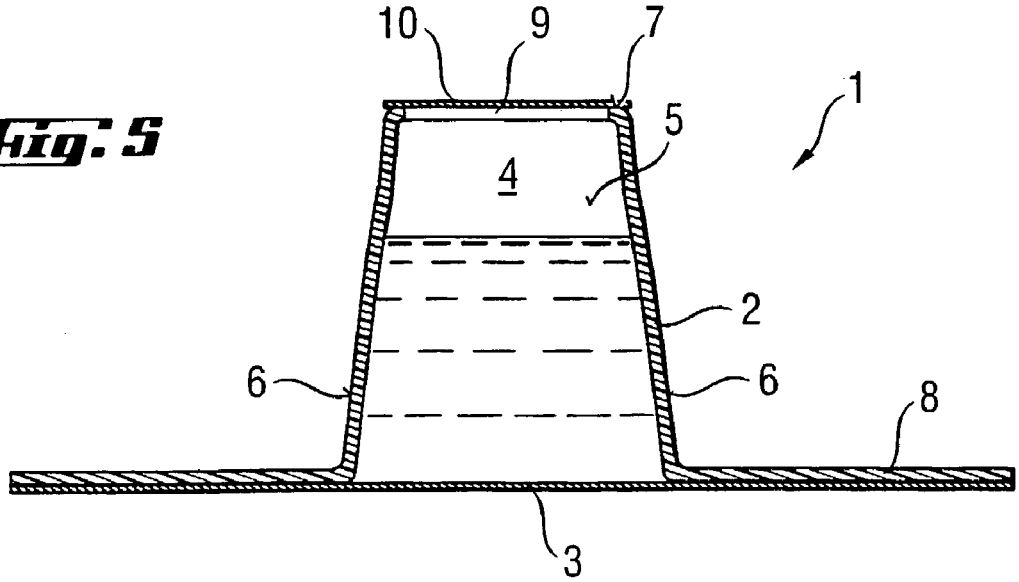

PACKAGE FOR A PHARMACEUTICAL PRODUCT AND METHOD OF MANUFACTURING AND STERILIZING THE PACKAGE

The invention relates to a package for a pharmaceutical product, particularly a blister package used to dispense liquids, cream, ointment or gel, and a method of manufacturing and sterilizing said package.

It is well known to use dropper bottle assemblies to dispense a variety of liquids, typically one drop at a time. For example, the dispensing of a liquid reagent used in laboratories, dispensing eye medication, dispensing ear medication, dispensing nose medication, or in any other environment where dispensing of a liquid in controlled drop increments is desired.

A typical prior art bottle assembly comprises a plastic squeeze bottle, a nozzle tip or dropper which is snap fit into the bottle and a cap or closure which is threaded onto the bottle. Liquid is dispensed one drop at a time by squeezing the bottle so as to force liquid out the end of the nozzle tip. The bottle, the nozzle tip and the cap are normally made of low density polyethylene because this material has a high enough modules of elasticity for squeezing the cylindrical side wall of the bottle with one's fingers which causes the liquid therein to pass through a passageway. Typically, these bottles are used for a multidose presentation and not for a single dose presentation.

For filling the bottle with a pharmaceutical product, particularly an ophthalmic liquid which has to fulfill the conditions concerning sterility, it is state of the art to filtrate and to sterilize the solution or liquid which should be filled into the bottles by filtration or autoclaving. Also the bottles, the nozzle tips and the caps are sterilized, e.g. by ethylene oxide treatment, gamma, electron beam irradiation or steam sterilization. The filling of the bottles takes place in aseptic room conditions. However, after filling the bottles, inserting the nozzle tip into the neck portion and threading the cap onto the bottle no further sterilization will proceed. The filled and closed bottles are removed from the aseptic area. The aseptic area is normally a room which stands under slight excess air pressure and the entrance and the exit of the room are constructed as sluices.

Further, there is a need for a package which can be used for a single dose application. This is particularly recommended if the risk of contamination is quite high by using a package for a pharmaceutical product several times, for example a bottle to apply eye drops which contain no preservative and can therefore be contaminated by contact with the eye and external air. In addition, there is often a demand to apply a fairly well defined volume to assure a specified dose to be delivered or adsorbed. A large surplus cannot be allowed due to improper physiological effects from absorbency in non-target tissue or the inconveniences caused by over-flow on face or clothes. Also price considerations apply for expensive medications. As an example, beta-blockers or other expensive active ingredients, all having other than the desired pressure relieving action when absorbed by other body tissues than the eye. Typically such single dose units are produced by a blow filling seal process. Here low density polyethylene in a granulated form is poured into an extruder, then heating of the granulated material takes place and a moulding is formed. The pharmaceutical product is filled into the moulding and afterwards the moulding is closed by sealing. The whole process takes place in an aseptic area. For delivering the pharmaceutical procuct the consumer breaks off the sealed tip of the single dose unit. Frequently filaments arise by breaking off the tip which could effect injuries of the eye or the nose.

A pharmaceutical product as used hereinbefore or hereinafter is understood to relate in particular to a pharmaceutical composition, which is preferably an aqueous and/or a non-aqueous pharmaceutical composition or a mixture of a non-aqueous and an aqueous pharmaceutical composition, which is preferably a liquid solution, a gel or an ointment, wherein pharmaceutical relates preferably to an ophthalmic, an otic and/or a nasal administration.

However, the standard method of filling bottles with pharmaceutical substances, particularly with ophthalmic solutions and gels does not fulfill the European Pharmacopoeia, 3rd. edition (1997) e.g. page 283, and/or the EU regulation (Committee of Proprietory Medicinal Products [CPMP], Section 5, Manufacturing Process, Note for Guidance). According to this regulation, an ophthalmic pharmaceutical liquid or gel should be terminally sterilized in their final container for achieving the highest level of sterility assurance, if ever possible.

The circumstances mentioned place severe demands on an applicator. The necessarily small preparation amount has to be positioned with great care in the eye not to invoke the dosing, overflow, side-effect and targeting errors mentioned. The positioning should be possible in at least one convenient patient posture for body, head and hand. Strained body positions are not only a convenience problem but may result in forced errors from stressed operation and trembling. It is desirable that the administration can be conducted in different body positions such as standings, sitting and lying, if possible also highly independent of applicator orientation. Equally important is a natural and relaxed arm and grip position during orientation, contacting and applicating. The device should also assist the user in delivering a precise volume of the preparation and not allow too small or large or inadvertently repeated ejections. Preferably a single design should fit varying anatomies without adjustments and should not induce fear for contact pain or discomfort. These requirements should be met both at patient self-treatment and operator assisted treatment. When the administration responsibility is placed on the patient simplicity is vital to suit also children, elderly and disabled persons, perhaps with reduced sight capabilities and hand strengths. Particularly, the applicator should have a very smooth surface to avoid injuries of the eye or nose. Finally, a functional and convenient applicator device should meet several secondary demands, such as simple container filling, simple orifice opening and closure, ease of bottle identification and filling status control, overall design suitable to use and carry around in daily life and low costs for manufacture and assembly.

Prior art devices have only been able to a limited extent to fulfill the demands stated. Generally, devices for delivery of large fluid volumes are of little assistance in solving the specific problems concerning convenience, positioning and dosing in small volume delivery applications.

The invention addresses the problem of providing a pharmaceutical package, particularly a blister package filled with a pharmaceutical product, particularly an ophthalmic solution or gel, which meets the requirements of the European Pharmacopoeia regulation and/or EU-regulation without any significant deformation after the autoclaving proceedings. Furthermore, the invention addresses the problem of providing a package for a single dose unit without causing high costs and better meeting the specific and general design demands explained.

The invention solves this problem with the features indicated in both claims 1 and 10. With regard to further advantageous design features, reference is made to the dependent claims.

The use of a specific form of polypropylene for the material of the package enables to fulfill the European Pharmacopoeia regulation and/or EU regulation. Packages made of a specific form of polypropylene are heat-resistant and retain their formation after the autoclaving processing. Further, the invention provides a blister package for a single dose application particularly for dispensing an ophthalmic solution or gel by impressing the cover sheet of the package. As the blister package is manufactured by a thermoforming process and not by an injection molding process or blow filling seal process the costs are less expensive in term of primary packaging components and investment equipments.

Figure 2:
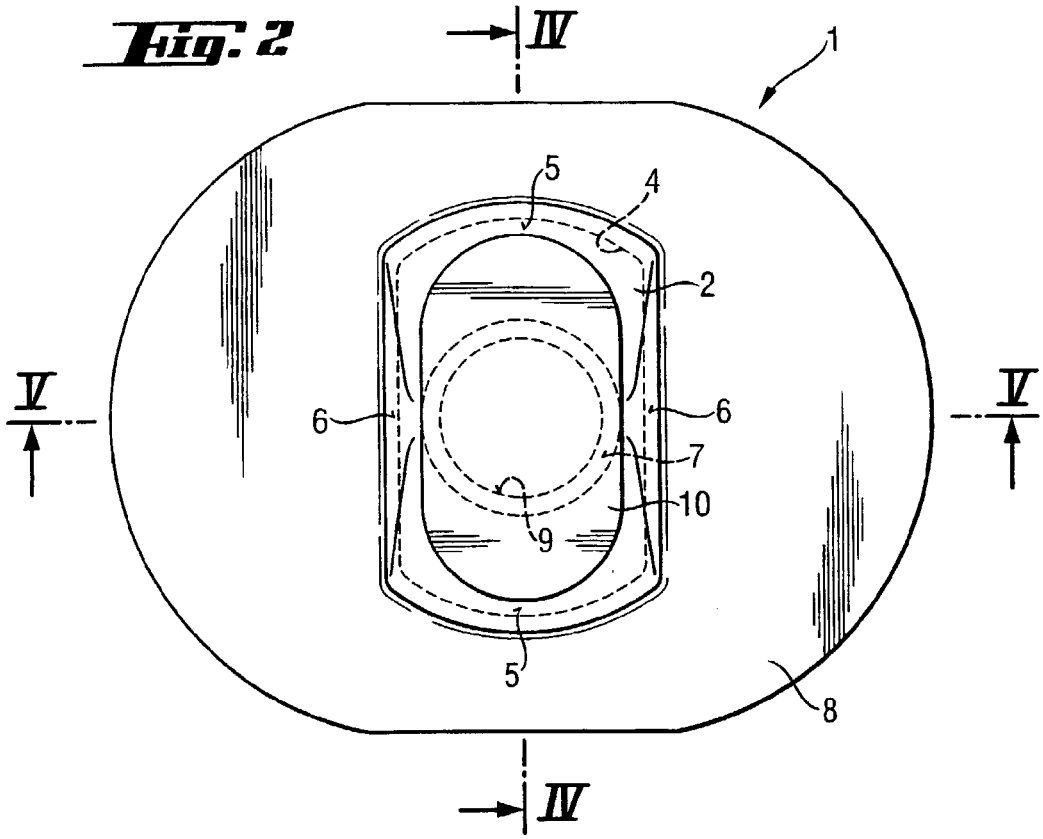
Figure 3:
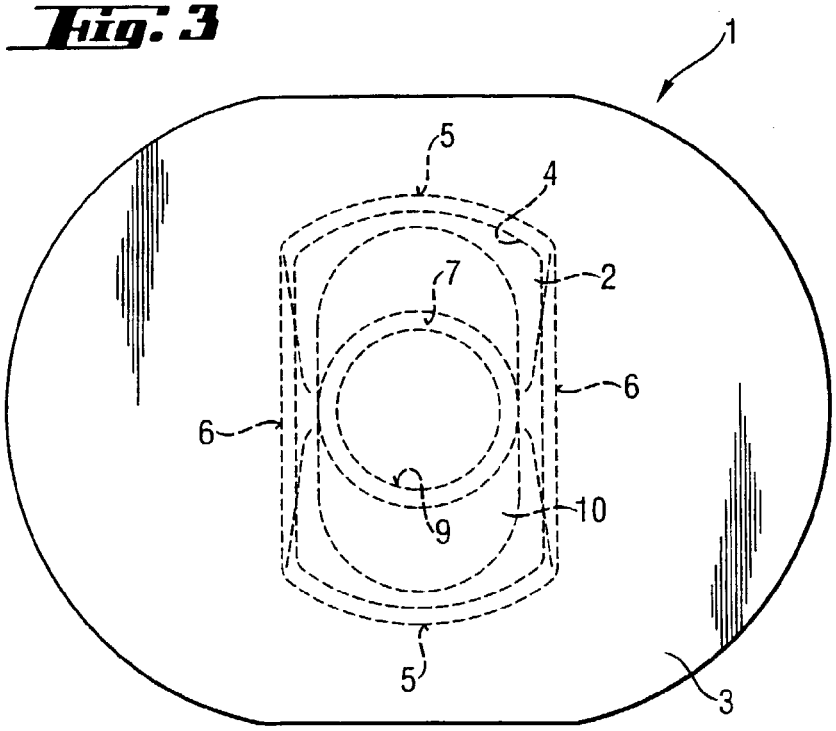
Figure 6:
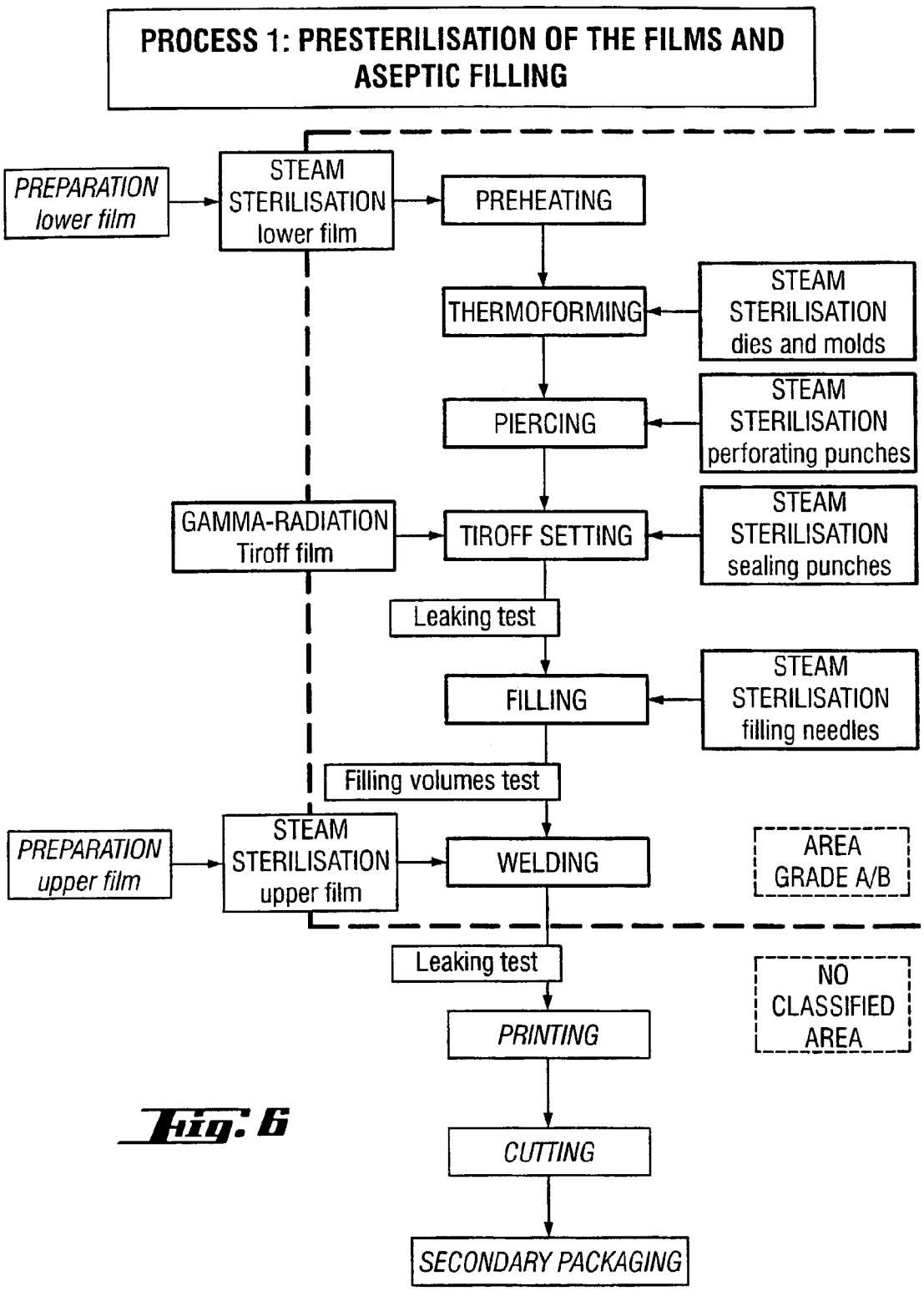
Figure 7:
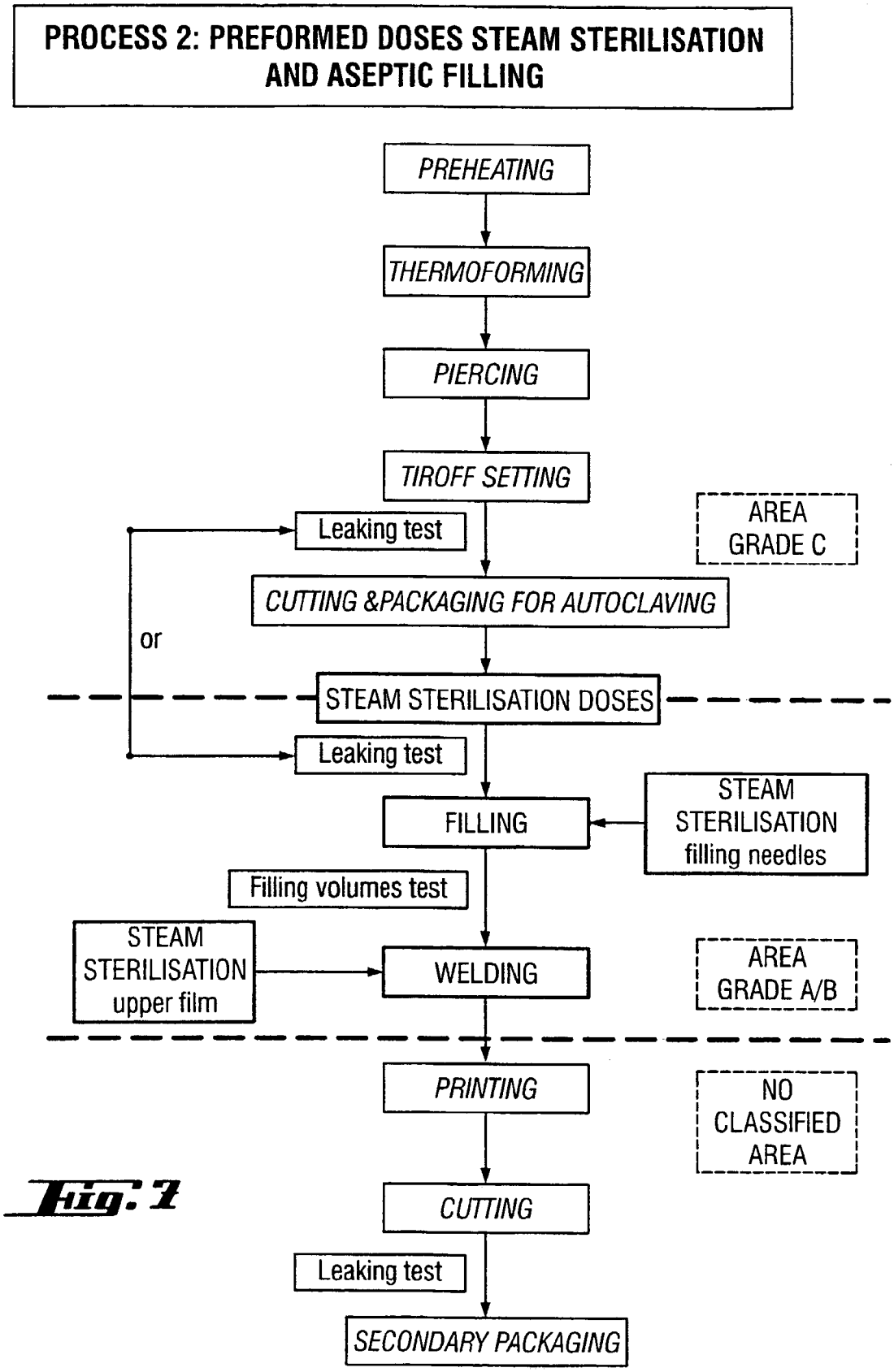
Figure 8:
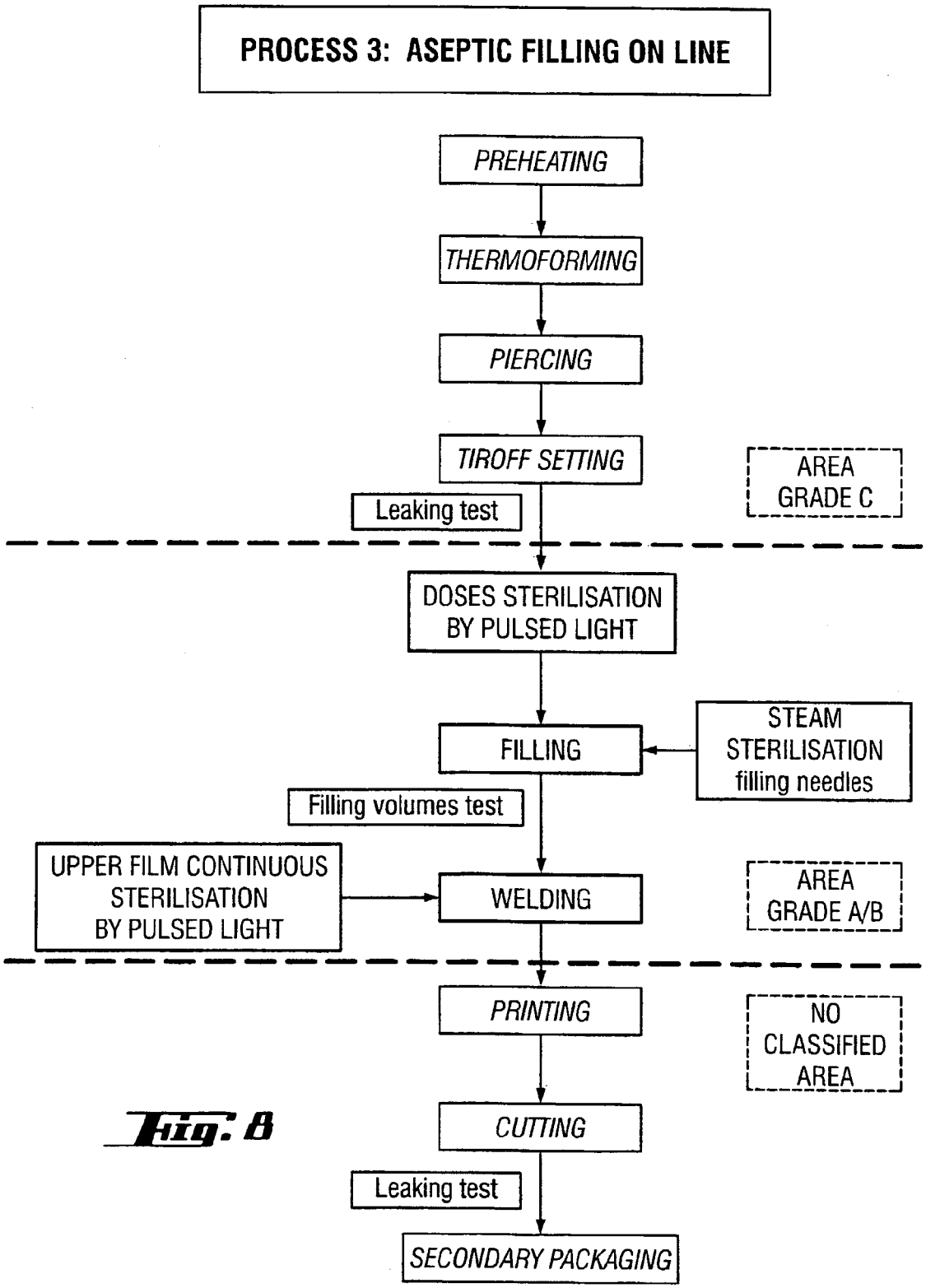

Further details and advantages of the invention are apparent from the following description and drawings. The drawings show:

FIG. 1 a three-dimensional view of a blister package according to the present invention;

FIG. 2 a top plan view of the blister package of FIG. 1;

FIG. 3 a bottom plan view of the blister package of FIG. 1;

FIG. 4 a side plan view of the blister package along line IV—IV in FIG. 2;

FIG. 5 a side plan view of the blister package along line V—V in FIG. 2;

FIG. 6 a diagram of a first process to manufacture and to sterilize a blister package according to the invention;

FIG. 7 a diagram of a second process to manufacture and to sterilize a blister package according to the invention;

FIG. 8 a diagram of a first process to manufacture and to sterilize a blister package according to the invention.

Referring to FIG. 1, there is illustrated a preferred embodiment of a blister package 1 according to the present invention. The blister package 1 consists of a lower base portion 2 and a cover member 3. The lower portion includes a cavity indicated generally as 4 which is advantageously formed by inclined sidewalls 5 and upstanding side walls 6 and a bottom 7 which has a circular, flat and smooth surface. The cavity 4 is surrounded by outward extending flange 8. Cover member 3 is welded completely to flange 8 around the opening of cavity 4. Cavity 4 is sized to receive a pharmaceutical product, preferably an ophthalmologic product. The volume of the cavity 4 can vary between about 0.3 to 1.5 ml or about 20 ml. The inclined side walls 5 preferably have a rounded geometry to avoid sharp edges for safety reasons. The upstanding side walls 6 have preferably no rounded portions in order to stabilize the cavity 4 as in the contact area of the side walls 5, 6 the cavity 4 is quite rigid.

As illustrated in FIG. 1, that portion of flange 8 and cover 3 adjacent the cavity 4 extends well beyond the cavity area. Therefore, this part of the blister package can provide as gripping means. Further, the cover member 3 covering the cavity 4 and the flange 8 can be used as a receptive surface for later printing parameters such as the trademark, lot number, expiry date, a bar code or other product information. Printing can be done by ink jet printing, but other methods as laser printing are also possible.

As is illustrated more clearly in FIG. 2—FIG. 5, the bottom surface 7 has in the centre an calibrated orifice 9 which is closed by a second cover member 10 preventing the blister package from any leakage. This second cover member 10 is sealed to the flat bottom surface 7 and extends well beyond the bottom area 7. Advantageously the cover member 10 is a polypropylene foil and the unsealed edges of the cover member 10 thereby provide gripping means whereby the cover member 10 may be readily stripped from the bottom surface 7 to gain access to orifice 9. This can easily be handled as the flange 8 serves as a second gripping means for holding the blister package in the other hand. The pharmaceutical product, preferably a liquid is dispensed by first removing the second cover member 10 and then impressing the cover member 3 of the package with one's fingers which causes the liquid therein to pass through the orifice 9. As the bottom area 7 has a flat surface and no sharp edges, the risk of an injury is minimized. Therefore, the blister packages 1 can be used also for ophthalmological applications as this part of the blister package comes very close to the eye when eye drops are applied. The liquid or gel in the blister package can be easily released as no high pressure is needed, which is advantageous especially for elderly persons having not sufficient strength in their finger tips anymore.

The lower portion 2 of the package according to the present invention is preferably produced by thermoforming a specific form of polypropylene sheet material, which fulfills the European Pharmacopoeia, 3rd. edition (1997), and/or the EU regulation mentioned above, which ensure a higher level of safety. The sheet material has a thickness of about 0.3 mm to about 0.7 mm, preferably about 0.5 mm. Such a low thickness is not known in the prior art as the normally used polypropylene or polyethylene sheet material has a thickness of 0.8 mm and more. If the sheet thickness is too thin, then the stability of the formed blister package decreases. However, if the wall thickness is too thick, then the squeezability of the package decreases and the bottle becomes too rigid. Indeed, the preferable value of the wall thickness is lower than in comparison with the prior art polypropylene or polyethylene blister packages which are typically twice as thick as the polypropylene blister-package of the present invention, so that there is much lesser material necessary for producing the blister packages. Preferably, if the product is not sensitive to light the polypropylene is clear or if the product is sensitive to the light the polypropylene may be white by addition of titanium dioxide.

In FIG. 6 a first possible process of manufacturing and sterilizing a blister package according to the present invention is illustrated. At a preparation station the plastic film material for the lower base portion 2 and the upper film material for the cover member 3 are prepared for the following steam sterilization in an autoclaving chamber. Preferably the plastic film material is a polypropylene film material. The thickness of the film material for the lower base portion 2 is about 500 micrometer, whereas the thickness of the film material for the cover member 3 is about 100 micrometer. Preferably, at this station transversal holes are pressed into an intermediate film located between the two layers formed by the lower and upper film material for the steam flow in the autoclaving chamber. The complete system is packaged around a mandrel as a roll. In the autoclaving chamber this packaged film material is sterilized by a temperature of 121° C. during 20 minutes. Subsequently, the preheating process of the film material for the lower base portion 2 takes place. The lower film material is progressively heated in three steps from 20° C. to about 200° C. between two hot-plates at each preheating station. Afterwards the lower base portion 2 of the blister package is thermoformed using dies and molds with a specific temperature for the dies and molds. The temperature, the pressure and the time can be regulated by computer-control. Typically, fifteen lower base portions are produced at one cycle, whereby one cycle takes six seconds. After the precursor of the blister package is provided, an orifice for delivering the product at the moment of the use by the customer is pierced through the flat bottom surface 7 of the blister package. At the subsequent station this orifice is closed by the second cover member 10 which is a Tiroff-film. The Tiroff-film is also a plastic foil, preferably a polypropylene foil with a thickness of about 50 micrometer to about 100 micrometer and can be sterilized by gamma-radiation or steam sterilisation. By means of temperature, pressure and surface contact between the bottom surface 7 and the Tiroff this part is sealed. The temperature, the pressure and the surface contact can be regulated by computer-control. The dies, molds, perforating punches and sealing punches are also sterilized in an autoclaving chamber before used at the thermoforming, piercing and Tiroff setting stations. After closing the orifice it is tested if the lower base portion is free from leakage. If this is the case, the cavity is filled from the top with the liquid/gel or ointment, again fifteen units at one time. This filling takes place under aseptic conditions. Subsequently, the upper film is welded onto the flange. The welding procedure requires a temperature of about 150 to 160° C. In contrast to sealing the welded parts could not be separated again. By means of temperature, pressure and surface contact between the filled unit and the upper film are welded. The temperature, the pressure and the surface contact can be regulated by computer-control. Afterwards the filled and welded blister packages are transferred out of the aseptic area and a second leakage test is performed. Then the upper film of the blister packages is printed with product parameters by ink jet or laser printing. At the last station the film material is cut into a strip of preferably five single units, which are packed into a secondary packaging.

FIG. 7 and FIG. 8 show process variations. In the process according to FIG. 7 the preheating, thermoforming, piercing and Tiroff setting stations take place in a non-aseptic area. Then the film material is cut into suitable parts for an autoclaving procedure. After a leaking test the sterilized units are filled with the pharmaceutical product under aseptic conditions. Then the sterilized upper film is welded onto the flange. Afterwards the filled and welded blister packages are transferred out of the aseptic area and the upper film of the blister packages is printed with product parameters. At the last station the film material is cut into a strip of preferably five single units, a further leaking test takes place and then the strips are packed into a secondary packaging.

The process illustrated in FIG. 8 is similar to the process of FIG. 7 with the exception that for the sterilization no autoclaving proceedings are performed but a sterilization by pulsed light. This enables to use a continuous process without the application of an autoclaving chamber.

Besides the three processes illustrated in FIGS. 6–8 where the filling of the blister packages takes place under aseptic conditions, it is possible to sterilize the filled, welded (and printed) blister packages by an autoclaving process. In this case it is advantageous to adjust the autoclaving processing to the blister packages to avoid damages as shrinkage or blowing-up. After filling the blister packages with the pharmaceutical liquid or gel, particularly an ophthalmic liquid or gel, the closed blister packages are introduced into an autoclaving chamber. As the whole bottles will be sterilized it is not anymore necessary that the filling and closing of the bottles has to take place under aseptic conditions. As it is known in the prior art, such an autoclaving chamber works with steam. The chamber contains typically one or more nozzles for the steam entrance and typically several sensors for temperature monitoring. Advantageously the temperature can be adjusted very quickly if some corrections might be necessary. Further, particularly the chamber is provided with a pressure device for generating a counter pressure in the autoclaving chamber. Also the pressure can be adjusted very quickly if some corrections might be necessary. Preferably, the counter pressure is regulated electronically via computer control. Said pressure set-up is advantageously used for avoiding a blowing-up of the bottles. After introducing the bottles into the chamber, the temperature rises typically from room temperature to 121° C. and the pressure rises typically from atmospheric pressure to a maximum value which is characteristic for the sterilization process. Typically, the choice of the pressure value depends on the form of the bottles.

Several test programs have shown that after an autoclaving procedure at a temperature of 121° C. during 20 minutes with an autoclaving procedure according to the above described diagrams no deformation, e.g. shrinkage or blowing-up of the polypropylene blister packages can be observed.

Therefore, the invention provides a plastic package particularly a blister package for pharmaceutical products, especially for ophthalmic pharmaceutical solutions and gels which can be sterilized as a whole after filling the product into the package by an autoclaving process in accordance to the invention. Furthermore, no deformation can be observed after having exposed said package to an autoclaving process in accordance to the invention. This means that a package according to the invention, especially a blister package with an ophthalmic solution, gel or ointment, fulfills the European Pharmacopoeia, 3rd. edition (1997), and/or the EU regulation mentioned above, which ensure a higher level of safety in term of sterility and of easy and safety use. Further, the invention provides an attractive and less expensive blister package for the merchandising of pharmaceutical products, particularly eye drops, and is constructed in a manner which facilitates production.

In addition, the plastic material, particularly the polypropylene material used for fabricating the package in accordance to the invention exhibits physical chemical properties which meet the requirements laid down in the supplement of 1998 of the European Pharmacopoeia, 3rd edition (1997). This is in particular applicable to the additives comprised in the PP-material in accordance to the invention. However, the package of the present invention may be constructed of materials other than those identified herein.

The invention claimed is:

1. A method of manufacturing and sterilizing a pharmaceutical package wherein the package comprises a lower base portion having a cavity for containing the pharmaceutical product and a flange extending outwardly about the periphery of the cavity, the cavity being defined by a bottom surface and side wall surfaces, extending between the bottom surface and the flange, and a flexible cover sheet welded to the flange, a calibrated orifice in the bottom surface which is covered by a second cover member releasably sealed to the bottom surface around the perimeter of the orifice, the method comprising the steps:

a) preparing a plastic lower film material for the lower base portion and a plastic film material for the upper film material for the cover member by locating an intermediate film between the two layers formed by the lower and upper film material for the following steam sterilization in an autoclaving chamber;

b) sterilizing the packaged film material in the autoclaving chamber by a temperature of 121° C. during 20 minutes;

c) preheating the lower film material by progressively heating in three steps from 20° C. to about 150° C. between two hot-plates at each preheating station;

d) thermoforming the lower base portion by using dies and molds with a specific temperature for the dies and molds and by regulating the temperature, the pressure and the time by computer-control;

e) piercing a calibrated orifice through the bottom surface for delivering the product at the moment of use by a customer;

f) closing the orifice by the second cover member which is sterilized by gamma-radiation or steam;

g) filling the cavity of the lower base portion from the top with the pharmaceutical product; and h) welding the upper film onto the flange.

2. A method according to claim 1, wherein transversal holes are pressed into the intermediate film between the two layers formed by the lower and the upper film materials for the transfer of steam flow.

3. A method according to claim 1, wherein the plastic lower film material for the lower base portion is made of polypropylene and has a thickness of about 300 micrometer to about 700 micrometer.

4. A method according to claim 1, wherein the plastic upper film material for the cover member is made of a polypropylene foil material and has a thickness of about 50 micrometer to about 100 micrometer.

5. A method according to claim 1, wherein the second cover member is a Tiroff-film of a polypropylene foil with a thickness of about 50 micrometer to 100 micrometer, which is sealed onto the bottom surface.

6. A method according to claim 1, wherein temperature, pressure and surface contact for the sealing processes are regulated by computer-control.

7. A method according to claim 1, wherein steps (c) to (h) are performed under aseptic conditions.

8. A method according to claim 1, wherein the dies, the molds, piercing means, filling means and sealing means are sterilized in an autoclaving chamber or in a place with steam before being used in the thermoforming, piercing, filling and sealing steps.

9. A method according to claim 1, wherein the sealed package filled with the pharmaceutical product is transferred out of an aseptic area.

10. A method according to claim 1, wherein the method further includes a step of testing if the lower base portion is free from leakage after sealing the orifice and before filling the cavity of the lower base portion.

11. A method according to claim 1, wherein the method further includes a step of leaking testing of the package after sealing the upper film material onto the flange.

12. A method according to claim 1, further including printing product parameters onto the upper film of the package.

13. A method according to claim 12, wherein the printing is performed by using ink jet printing and/or laser printing technologies.

14. A method according to claim 1, further including cutting package-containing film material into strips of several single dose units and packing the strips of several single dose units into a secondary packaging.

15. A method according to claim 14, further including sterilizing the secondary packaging by steam or gamma-radiation before packing the strips of several single dose units into the secondary packaging.

* * * * *

UNITED STATES PATENT AND TRADEMARK OFFICE

CERTIFICATE OF CORRECTION

PATENT NO. : 7,067,084 B1
APPLICATION NO. : 10/110916
DATED : June 27, 2006
INVENTOR(S) : Leroy et al.

It is certified that error appears in the above-identified patent and that said Letters Patent is hereby corrected as shown below:

[*] Notice: Subject to any disclaimer, the term of this patent is extended or adjusted under 35 USC 154(b) "by (624) days" should read -- by 563 days--

Signed and Sealed this

Twenty-sixth Day of December, 2006

JON W. DUDAS
*Director of the United States Patent and Trademark Office*